US005334907A

United States Patent [19]

Desmur et al.

[11] Patent Number: 5,334,907

[45] Date of Patent: Aug. 2, 1994

[54] COOLING DEVICE FOR MICROWAVE TUBE HAVING HEAT TRANSFER THROUGH CONTACTING SURFACES

[75] Inventors: Henri Desmur, Fontenay Aux Roses; Robert Duret, Maurepas, both of France

[73] Assignee: Thomson Tubes Electroniques, Velizy, France

[21] Appl. No.: 964,883

[22] Filed: Oct. 22, 1992

[30] Foreign Application Priority Data

Oct. 25, 1991 [FR] France ..... 91 13216

[51] Int. Cl.[5] ..... H01J 23/00

[52] U.S. Cl. ..... 313/36; 313/46; 315/3

[58] Field of Search ..... 315/4, 5, 3; 313/45, 313/46, 35, 36, 17

[56] References Cited

U.S. PATENT DOCUMENTS

| | | | |
|---|---|---|---|
| 2,715,518 | 8/1955 | Bickler | 313/46 X |
| 2,845,474 | 7/1958 | Langworthy et al. | 313/45 X |
| 3,274,429 | 9/1966 | Swiadek | 313/36 X |
| 3,398,315 | 8/1968 | Washburn | 313/467 |
| 3,876,901 | 4/1975 | James | 313/36 X |
| 4,559,474 | 12/1985 | Duret et al. | 315/3.6 |
| 4,798,993 | 1/1989 | Duret et al. | 313/447 |
| 5,021,708 | 6/1991 | Nugues et al. | 313/446 |
| 5,045,749 | 9/1991 | Desmur | 313/305 |

FOREIGN PATENT DOCUMENTS

| | | | |
|---|---|---|---|
| 0361047 | 4/1990 | European Pat. Off. . | |
| 2533364 | 3/1984 | France . | |
| 15240 | 7/1965 | Japan | 313/46 |

OTHER PUBLICATIONS

Scherba, M. K.; "Space tube with high efficiency cooling design approach"; IEEE 1980 pp. 164–167.

Patent Abstracts of Japan, vol. 4, No. 1 (E-163) Jan. 8, 1980, & JP-A-54 142 063, "Multi-Step Collector Type Electron Beam Tube".

*Primary Examiner*—Benny T. Lee

*Attorney, Agent, or Firm*—Oblon, Spivak, McClelland, Maier & Neustadt

[57] ABSTRACT

A cooling device for microwave tubes includes a cold part and a heat-conducting member having a first surface in contact with a surface of the cold part. A second surface of the heat-conducting member is in contact with an envelope of the tube. The surface of the cold part and the first surface of the heat-conducting member are respectively concave and convex. The device can be applied to the cooling of microwave tubes including klystrons, travelling-wave tubes and gyrotrons.

8 Claims, 4 Drawing Sheets

COOLING DEVICE FOR MICROWAVE TUBE HAVING HEAT TRANSFER THROUGH CONTACTING SURFACES

BACKGROUND OF THE INVENTION

1. Field of the Invention

The present invention relates to microwave tubes and, more particularly, to longitudinal interaction tubes such as travelling-wave tubes or klystrons. It can even be applied to gyrotrons. The operation of these tubes is based on an exchange of energy between an electron beam and microwave energy. The electron beam is emitted in a gun, by a cathode. The gun is placed at the input of a tubular interaction space. The electron beam is long and thin. It crosses the interaction space. A focusing device surrounds the interaction space and confines the electrons of the beam to desired paths.

Microwave energy is injected into the interaction space. It interacts with the electron beam and is amplified. The microwave energy is extracted by an appropriate device at an output of the interaction space. The electron beam ends its travel in a collector located at an output of the interaction space.

The interaction space comprises a microwave circuit which is generally either a helix delay line in the case of a travelling-wave tube or a sequence of resonant cavities in the case of a klystron. The interaction space is taken to a potential that is generally a ground.

After having yielded a part of its energy to the microwave energy, the electron beam still has substantial kinetic energy when it penetrates the collector. The collector dissipates this energy in the form of heat. The collector, gun and interaction space and brought together in a vacuum envelope that is positioned on a flange mounted on a cold part. The flange contacts a heat-conducting member located between the envelope and the cold part which is cooled by natural or forced convection, by the circulation of a fluid or by radiation. The cooling is done by thermal conduction through the flange. Since the collector is the part that dissipates the greatest amount of heat, it should be especially well cooled. The envelope, at the level of the collector, is held in a clamp that generally forms one piece with the flange.

2. Description of the Prior Art

The efficiency of prior art tubes is generally low, and the energy of the electrons penetrating the collector is greater than that of the microwave collected at output of the tube. To increase this efficiency, it has been necessary to use a so-called "depressed" collector. It is sought to recover a part of the energy of the electrons of the beam by decelerating them. A depressed collector is carried to an intermediate potential between the potential of the cathode and that of the interaction space. The collector may comprise an electrode or several successive electrodes. When there are several electrodes, they are carried to potentials that decrease with distance from the interaction space. The collector then has several stages. The use of a depressed collector contributes to increasing the efficiency of the microwave tube and to reducing the difficulties encountered in removing the heat. The power dissipated as heat on the collector can be reduced to a value close to that of the microwave power at the output of the tube.

This power very often continues to remain high and its discharge calls for a substantial exchange surface area between the flange and the cold part. This may raise problems if it is desired to restrict the space occupied by the tube.

The collector is formed by one or more electrodes in the form of cups, drilled in their central part, insulated from the conductive envelope by non-conductive rods. There may be a difference in temperature of some degrees centigrade between the internal and the external walls of the electrodes. There may be a difference of some tens of degrees between the face of the rods in contact with the electrodes and the face in contact with the envelope. There may be a difference of some hundreds of degrees between the face of the flange in contact with the envelope and the face in contact with the cold part.

Another known approach used to improve the cooling of the tube and notably that of the collector is to integrate heat channels between the electrodes and the envelope of the collector. However, this approach leads to a heavy and bulky tube, the operation of which may border on inefficiency.

SUMMARY OF THE INVENTION

The present invention seeks to improve the cooling of electron beam tubes, especially that of their collector, without substantially increasing their space requirements.

The present invention proposes a cooling device for microwave tubes, comprising a cold part, a heat-conducting member having a first surface in contact with a surface of the cold part and a second surface in contact with an envelope of the tube. The surface of the cold part and the first surface of the heat-conducting member are respectively concave and convex in order to increase the area of contact there-between without increasing the space occupied by the cooling device.

The concave and convex surfaces may be respectively recessed and projecting dihedrons, the dihedrons having respectively the same angle.

The recessed dihedron may have a groove placed at the intersection of its two planes.

In other variants, the concave and convex surfaces may be polyhedrons with at least three faces, and may be capable of overlapping at least partially. In yet other variants, the concave and convex surfaces may each include at least one cylindrical surface portion and may be at least partially capable of overlapping.

To improve cooling, the envelope may be partially or wholly embedded in the heat-conducting path.

The cold part may be cooled by the circulation of a fluid or by convection or by radiation.

The microwave tube may be a tube belonging to the category of devices which includes klystrons, travelling-wave tubes or gyrotrons.

BRIEF DESCRIPTION OF THE DRAWINGS

The present invention shall be understood more clearly from the description illustrated by the following figures, of which:

As seen in FIGS. 1*a*, 1*b* the general views are all drawn to one and the same scale. For purposes of clarity, the cross-sections are all drawn also to one and the same scale, which is other than the scale hereinabove. In these different figures, the same elements bear the same references.

DETAILED DESCRIPTION OF THE PREFERRED EMBODIMENTS

Figure 1A:
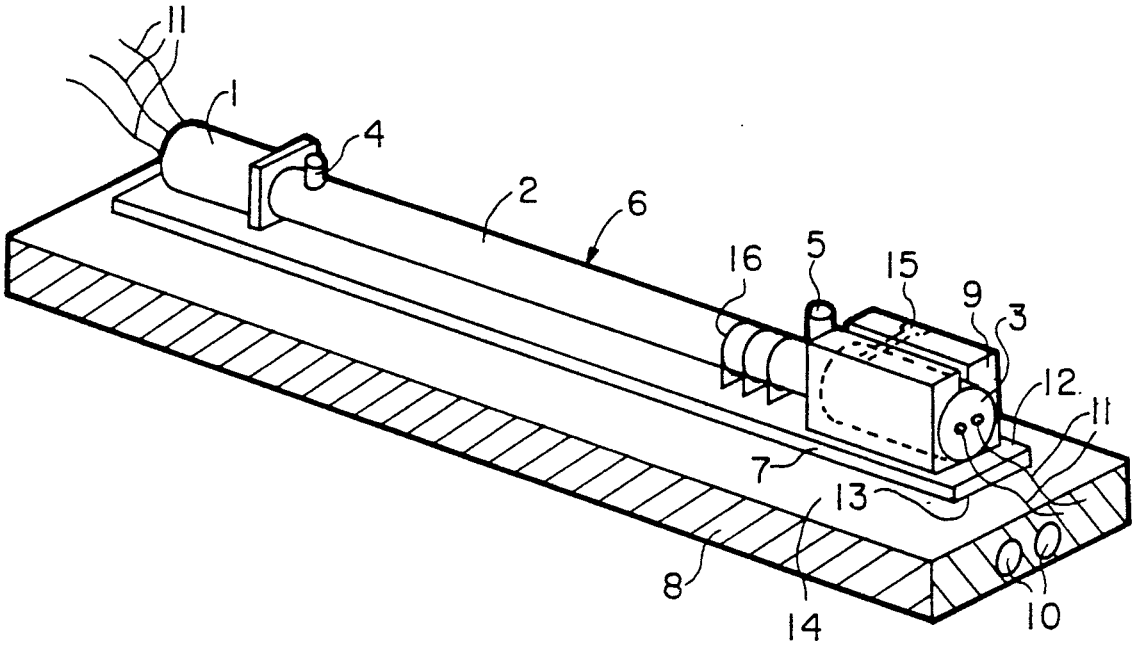
FIG. 1a (PRIOR ART)
FIGS. 1*a* and 1*b* show a general view and a cross-sectional view, respectively, of a microwave tube comprising a known type of cooling device.

FIG. 1*a* shows a general view of a travelling-wave tube according to the prior art.

Figure 1B:
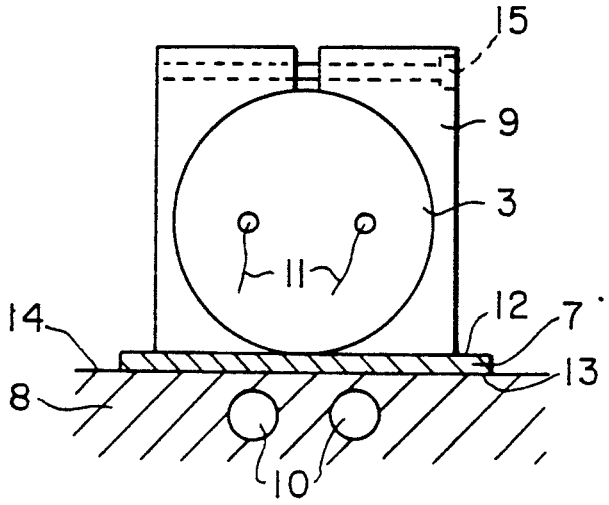
FIG. 1b (PRIOR ART)

FIG. 1*b* shows a view of the tube of FIG. 1*a* from the side, towards the collector. The tube has a gun 1 for emitting electrons, an interaction space 2 within which the electrons interact with a microwave from a microwave device, and a collector 3 collecting the electrons. The microwave is injected into an input connection 4 from the microwave device and extracted at an outut connection 5. The gun 1, the interaction space 2 and the collector 3 are brought together in a conductive envelope 6 having the shape of a cylinder generated by revolution. The envelope 6 lies on a flange 7 that is used as a heat-conducting path between the tube and a cold part 8. The flange 7 and the cold part 8 contribute to forming a device for the cooling of the tube. The flange 7 has a clamp-shaped element 9 which grips the envelope 6 at the position of the collector 3. The collector 3 is that part of the tube that dissipates the greatest quantity of heat. This heat should be removed with particular efficiency. The amount of heat produced by the rest of the tube is smaller but should nevertheless be removed in order to reduce the risks of deformation due to heat expansion. The clamp-shaped element 9 is slit along a generatrix of the envelope 6 to enable the introduction of this envelope. The clamping may be achieved by means of a system 15 using screws for example.

The cold part 8 is cooled by the circulation of a fluid. It has two channels 10 for the circulation of the fluid. It could be cooled by other means, for example by natural or forced convection or else by radiation.

Current supply wires 11 are connected to the gun 1 and to the collector 3. Straps 16 are used to keep the envelope 6 mechanically on the flange 7. They are placed at the level of the interaction space 2. They are also used for the removal of the heat towards the cold plate 8.

The flange 7 is a plate with plane, substantially parallel faces, and so is the cold part 8. The flange has a first face 12 in contact with the envelope 6 of the tube and a second face 13, opposite the first face 12, in contact with one of the faces 14 of the cold part 8.

Figure 2B:
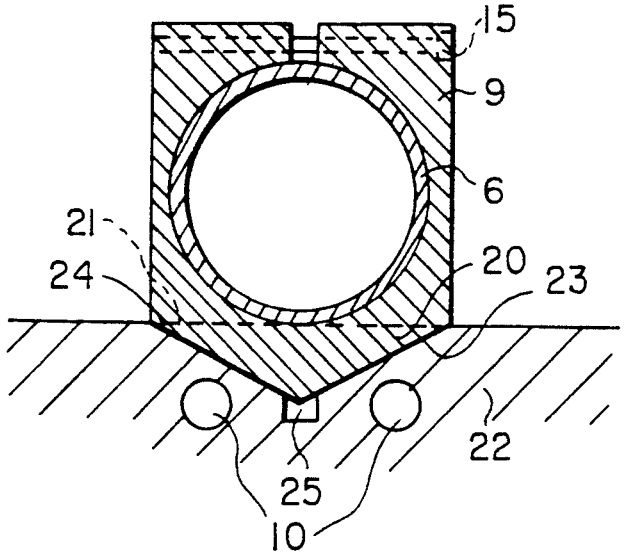
FIGS. 2*a* and 2*b* show a general view and a cross-sectional view, respectively, of a microwave tube provided with a cooling device according to the invention.
Figure 2A:
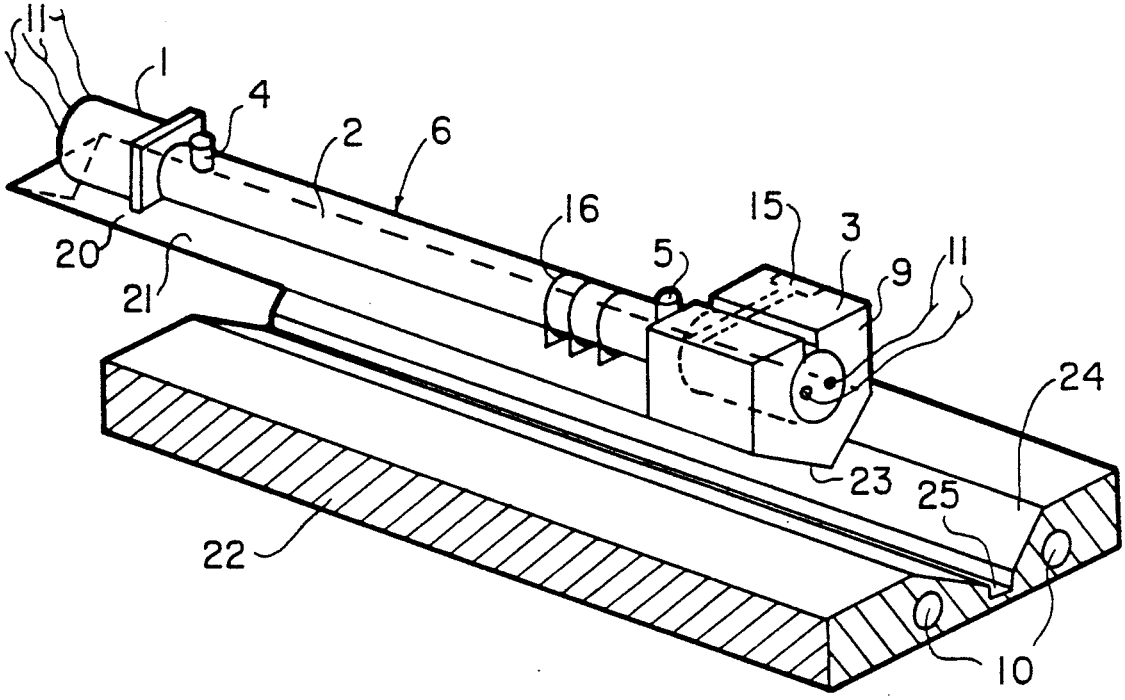

FIG. 2*a* shows a microwave tube and its cooling device according to the invention. The tube shown is a travelling-wave tube as shown in FIGS. 1*a* and 1*b*.

FIG. 2*b* is a cross-sectional view of the travelling-wave tube made at the collector.

FIG. 2*a* shows the gun 1, the interaction space 2 and the collector 3 brought together in the conductive vacuum envelope 6. The input connection bears reference number 4 and the output connection bears reference number 5. The current supply wires for the gun 1 and the collector 3 are indicated by reference number 11.

This figure also shows a cooling device essentially comprising a heat-conducting member 20 and a cold part 22.

The envelope 6 lies on the flange-shaped heat-conducting member 20 which has a first surface 21 in contact with the envelope 6 of the tube and a second surface 23 in contact with a surface 24 of the cold part 22. But now, the contact surfaces 23, 24 between the heat-conducting member 20 and the cold part 22 are respectively convex and concave.

Without increasing the space occupied by the tube, the area of the surfaces in contact have been increased and the efficiency of the cooling device has been improved.

In FIGS. 2*a* and 2*b*, the convex surface 23 of the heat-conducting member 20 is a projecting dihedron and the concave surface 24 of the cold part 22 is a recessed dihedron. The cold part 22 is provided with the channels 10 for the circulation of a fluid. The two dihedrons have substantially the same or equal angles of intersection at the vertex, and this angle may advantageously be between 60° and 130° depending on the dimensions of the tube and on the available space.

Preferably, the envelope 6 of the tube, at the collector 3, is gripped in a clamp-shaped element 9. This element 9 is comparable to the one shown in FIGS. 1*a* and 1*b*. This element 9 is preferably an element that forms one piece with the heat-conducting path 20, in order to prevent any increase in the thermal resistance of said heat conducting member. It is quite possible to envisage a case where the element 9 would be connected to the heat-conducting member 20 by any appropriate means.

In order that the contact between the two dihedrons may be as efficient as possible, taking account of imprecision in manufacturing, it would be advantageous to make a groove 25 in the cold part 22 at the intersection between the two planes of the recessed dihedron.

The dimensions on the groove 25 are typically of the order of one millimeter.

Instead of being dihedral, the surfaces in contact may be polyhedral with at least three faces. They may also each have at least one cylindrical surface portion. They are at least partially capable of overlapping.

Figure 3:
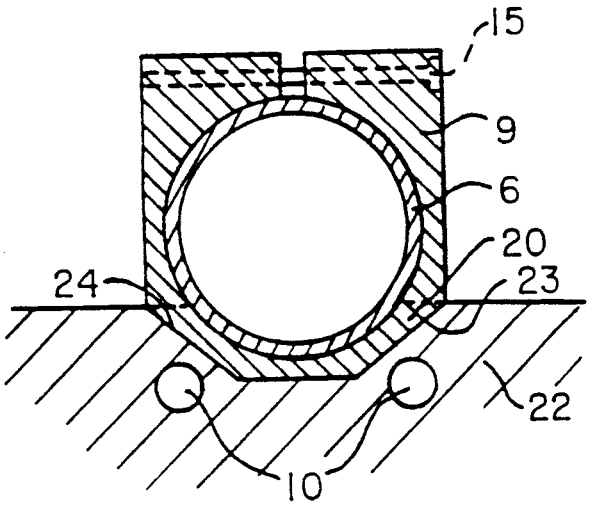
FIGS. 3, 4 and 5 show a cross-sectional view of different embodiments of the cooling device according to the invention.
Figure 4:
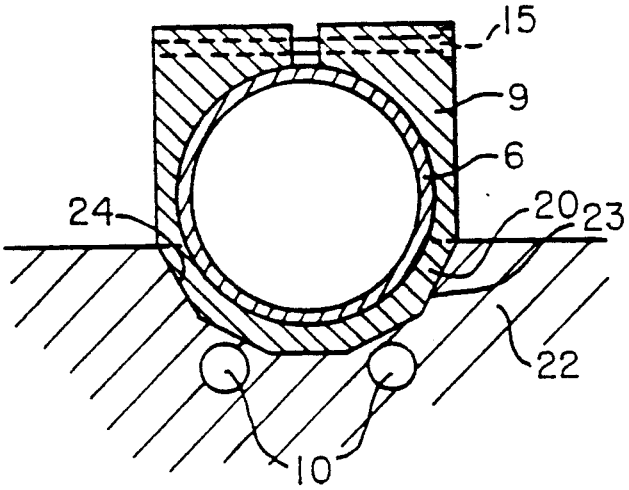
Figure 5:
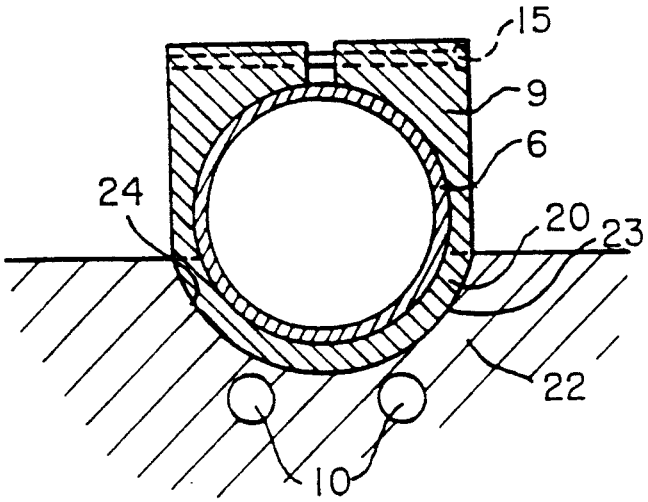

This is what is shown in FIGS. 3, 4 and 5.

In FIG. 3, the concave surface 24 of the cold part 22 and the convex surface 23 of the heat-conducting member 20 each have three faces in contact. In FIG. 4, they have five faces in contact. In FIG. 5, these two surfaces are circular-based portions of cylindrical surfaces of a shape generated by revolution, with substantially the same radius. These variants make it possible to increase the area of the surfaces in contact without increasing the space occupied by the tube. It is the variant of FIG. 5 that theoretically gives the optimum value of cooling, but it is preferable for the surfaces to be polyhedral to obtain the best interface, taking account of manufacturing imprecision.

Comparative tests have shown that the thermal resistance of a cooling device according to the invention could be reduced by 20% to 50% as compared with standard devices. With a collector having an internal diameter in the region of 10 mm, a thermal power density of several tens of watts per square centimeter may be discharged without the collectors temperature exceeding 100 degrees Celsius.

To further improve the efficiency of the cooling device according to the invention, the envelope of the tube can be at least partially embedded in the heat-conducting path. The distance between the envelope of the tube and the cold part is then substantially reduced and the contact surface between the envelope and the heat-conducting member is increased. This variant is shown in FIGS. 3, 4 and 5. The envelope 6 is partially embedded in the heat-conducting member 20.

Figure 6B:
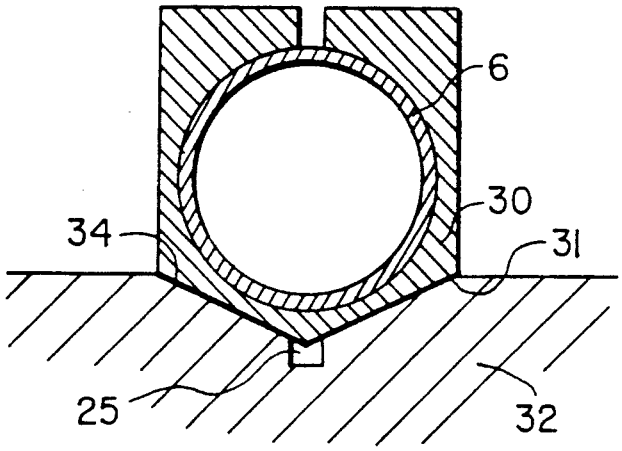
FIGS. 6*a* and 6*b* show a general view and a cross-sectional view, respectively, of a microwave tube provided with another embodiment of a cooling device according to the invention.
Figure 6A:
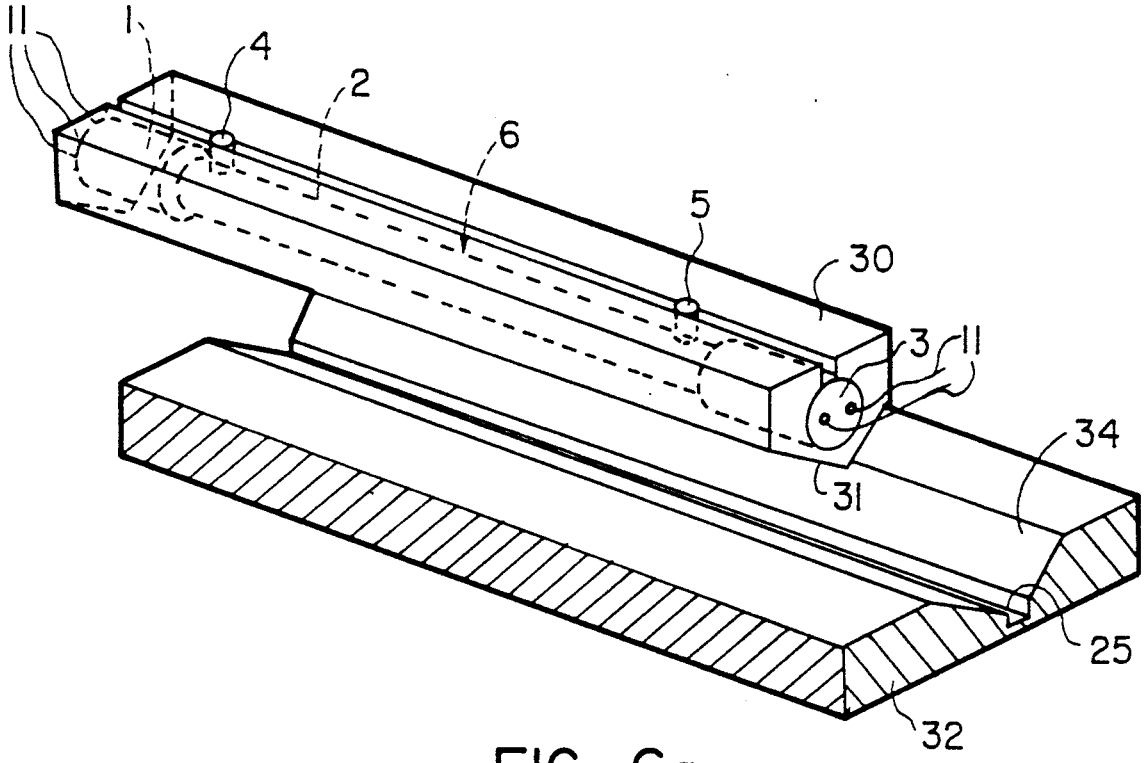

Instead of being partially embedded, the envelope may be practically totally embedded in member 20. FIGS. 6*a* and 6*b* illustrate this embodiment. The envelope 6 of the tube is totally embedded in a heat-conducting member 30. This heat-conducting path 30 has a dihedron-shaped convex surface 31 in contact with the concave surface 34 of the cold part 32. The heat-conducting member 30 has the general shape of a sheath that is slit along one of its generatrix lines. The slit enables the insertion of the envelope 6. Gripping means (not shown) are provided so that the envelope 6 is gripped in the heat-conducting member 30. This variant makes it possible, first of all, to considerably increase the area of contact between the heat-conducting member 30 and the envelope and, secondly, to reduce the distance between the envelope 6 and the cold part 32, if the envelope 6 is positioned appropriately inside the heat-conducting member 30. In this embodiment, it is assumed that the cold part 32 is cooled by natural convection or else by radiation.

The envelope of the tube will be advantageously made entirely or partially of copper or steel or of an alloy of these metals while the heat-conducting path and the cold part will be made of a material that is a good conductor of heat and electricity, for example aluminium or an aluminium alloy.

The cooling device according to the invention may be used in tubes of the categories including travelling-wave tubes, klystron tubes or even gyrotron tubes.

What is claimed is:

1. A microwave apparatus tube, which comprises: a microwave tube; and a cooling device for the microwave tube wherein said device includes a cold part and a heat-conducting member, the heat conducting member having a first surface in contact with a surface of the cold part and a second surface in contact with an envelope of the tube, wherein at least part of the surface of the cold part and at least part of the first surface are respectively shaped as a concave dihedron and a convex dihedron in order to increase an area of contact therebetween.

2. A cooling device for a microwave tube, comprising:

a cold part and a heat-conducting member, said heat-conducting member having a first surface in contact with a surface of the cold part and a second surface in contact with an envelope of the tube, wherein the surface of the cold part and the first surface of the heat-conducting member are respectively concave and convex in order to increase an area of contact therebetween, the convex surface is a projecting dihedron and the concave surface is a recessed dihedron and wherein each of the projecting dihedron and the recessed dihedron have planes which intersect; with equal angles of intersection.

3. A cooling device according to claim 2, wherein a groove is located in the cold part at the intersection of the two planes of the dihedron.

4. A cooling device for a microwave tube, comprising:

a cold part and a heat-conducting member, said heat-conducting member having a first surface in contact with a surface of the cold part and a second surface in contact with an envelope of the tube, wherein the surface of the cold part and the first surface of the heat-conducting member are respectively concave and convex in order to increase an area of contact therebetween and wherein the convex and concave surfaces are polyhedrons with at least three faces that at least partially overlap.

5. A cooling device for a microwave tube, comprising:

a cold part and a heat-conducting member, the heat-conducting member having a first surface in contact with a surface of the cold part and a second surface in contact with an envelope of the tube, wherein at least part of the surface of the cold part and at least part of the first surface of the heat-conducting member are respectively shaped as a concave dihedron and a convex dihedron in order to increase an area of contact therebetween.

6. A cooling device according to claim 5, wherein the envelope of the tube is at least partially embedded in the heat-conducting member.

7. A cooling device according to claim 5, wherein the cold part includes a device by which the cold part is cooled by circulation of a fluid through said device.

8. A cooling device according to claim 5, wherein the cold part includes a device by which the cold part is cooled.

* * * * *